United States Patent [19]

Verbruggen

[11] 4,426,299

[45] Jan. 17, 1984

[54] CONCENTRATED FABRIC SOFTENING COMPOSITION

[75] Inventor: Martin W. Verbruggen, Humbeek, Belgium

[73] Assignee: The Procter & Gamble Company, Cincinnati, Ohio

[21] Appl. No.: 309,330

[22] Filed: Oct. 6, 1981

Related U.S. Application Data

[63] Continuation of Ser. No. 110,144, Jan. 7, 1980, abandoned.

[30] Foreign Application Priority Data

Jan. 11, 1979 [GB] United Kingdom ..... 7901137

[51] Int. Cl.[3] ..... D06M 13/20; D06M 13/46

[52] U.S. Cl. ..... 252/8.8; 252/8.6

[58] Field of Search ..... 252/8.8

[56] References Cited

U.S. PATENT DOCUMENTS

| | | | |
|---|---|---|---|
| 3,349,033 | 10/1967 | Zuccarelli et al. | 252/8.75 |
| 3,793,196 | 2/1974 | Okazaki et al. | 252/8.8 |
| 3,954,634 | 5/1976 | Monson | 252/8.8 |
| 3,974,076 | 8/1976 | Wiersema et al. | 252/8.8 |
| 4,076,633 | 2/1978 | Edwards et al. | 252/8.8 |
| 4,149,978 | 4/1979 | Goffinet | 252/8.8 |
| 4,155,855 | 5/1979 | Goffinet et al. | 252/8.8 |
| 4,184,970 | 1/1980 | Draper | 252/8.8 |
| 4,308,024 | 12/1981 | Wells | 8/137 |

FOREIGN PATENT DOCUMENTS

| | | | |
|---|---|---|---|
| 2503026 | 7/1976 | Fed. Rep. of Germany | 252/8.8 |
| 6706178 | 11/1968 | Netherlands . | |
| 1453093 | 10/1976 | United Kingdom . | |

*Primary Examiner*—Maria Parrish Tungol

[57] ABSTRACT

A concentrated fabric softening composition comprises a water-insoluble cationic fabric softener and a viscosity control agent which is either a non-cyclic hydrocarbon, a fatty acid or ester thereof or a fatty alcohol, the ratio of fabric softener to viscosity control agent being from 5:1 to 20:1.

8 Claims, No Drawings

CONCENTRATED FABRIC SOFTENING COMPOSITION

This application is a continuation of application Ser. No. 110,144, filed Jan. 7, 1980, now abandoned.

This invention relates to fabric softening compositions and, in particular, to compositions in aqueous medium and containing a relatively high proportion of cationic fabric softener.

Conventional rinse-added fabric softening compositions contain fabric softening agents which are substantially water-insoluble cationic materials usually having two long alkyl chains. Typical of such materials are di-stearyl dimethyl ammonium chloride and imidazolinium compounds substituted with two stearyl groups. These materials are normally prepared in the form of an aqueous dispersion or emulsion, and it is generally not possible to prepare such aqueous dispersions with more than about 7% of cationic material, while still retaining acceptable viscosity and stability characteristics. This, of course, limits the level of softening performance achievable without using excessive amounts of product, and also adds substantially to the distribution and packaging costs, because of the need to market such dilute solutions of the active ingredient. Another advantage of a more concentrated fabric softening composition is that it permits the consumer to exercise choice in the type of performance desired, in that the concentrated product can either be used as such or can be diluted to a conventional concentration before use. This opens up the possibility of supplying the concentrated fabric softening composition in a more economically packaged form intended for making up by the consumer into a conventional bottle.

The problem of preparing fabric softening compositions in concentrated form suitable for consumer use has already been addressed in the art, but the various solutions proposed have not been entirely satisfactory. It is generally known (for example in U.S. Pat. No. 3,681,241) that the presence of ionizable salts in such compositions do help reduce viscosity, but these materials do not offer the additional benefit of enhancing the softening performance of the compositions. The use of certain special processing techniques has also been suggested in this regard (for example in U.S. Pat. No. 3,954,634) but again this does not provide a complete and satisfactory solution, and it is not an easy matter to adopt this type of process on a commercial scale. In our European patent application No. 78200059 (P (P&G Case CM-49), concentrated fabric softeners are disclosed which comprise three active softening ingredients, one of which is a highly soluble cationic fabric substantive agent. While such compositions do allow a high concentration of active ingredient, their overall softening performance is less cost effective than is the case with compositions containing predominantly a water-insoluble cationic softener. In our earlier British Patent Application No. 29238/77 (P&G Case CM-50) mixtures of cationic softener and paraffinic materials are proposed in a certain ratio which can allow the preparation of concentrated softening compositions when relatively high proportions of paraffinic materials are employed. The Dutch Patent Application No. 6706178 relates to viscosity control in fabric softening compositions with up to 12% of cationic softener, and suggests the use of low molecular weight hydrocarbons for this purpose. Finally, German Patent Application No. 25 03 026 discloses a complex softener/disinfectant composition in which a long chain fatty alcohol used at a relatively low ratio of cationic softener to alcohol is suggested as a solubilization aid.

It is an object of the present invention to provide a concentrated fabric softening composition having satisfactory physical characteristics for consumer use.

It is a further object of the invention to provide a concentrated fabric softening composition of low viscosity, good storage stability and containing a major proportion of cationic fabric softener.

According to the present invention, there is provided a fabric softening composition in the form of an aqueous dispersion comprising (a) from 8%–22% of a water-insoluble cationic fabric softener, preferably selected from di-$C_{12}$–$C_{24}$ alkyl or alkenyl mono-quaternary ammonium salts and di-$C_{12}$–$C_{24}$ alkyl or alkenyl imidazolinium salts and mixtures thereof, and (b) from 0.5%–4% of a viscosity control agent selected from (1) $C_{10}$–$C_{20}$ hydrocarbons, (2) $C_9$–$C_{24}$ fatty acids or esters thereof with alcohols containing from 1–3 carbon atoms, and (3) $C_{10}$–$C_{18}$ fatty alcohols, wherein the ratio of (a) to (b) is from 5:1 to 20:1.

When the cationic fabric softener is a mono-quaternary ammonium salt, it is highly preferred that this is present in an amount not greater than 16%, preferably 10% to 14%. When the cationic fabric softener is an imidazolinium salt, it is preferred this is present in an amount from 12% to 20%.

In the present specification, percentage figures given for components in a composition referred to the weight percent of that component in the composition.

Compositions of the present invention comprise two essential ingredients, a cationic fabric softener and a viscosity control agent which serves to reduce the viscosity of the aqueous dispersion and also provides an anti-gelling effect.

THE CATIONIC FABRIC SOFTENER

The water-insoluble cationic fabric softener can be any fabric-substantive cationic compound the acid salt form of which has a solubility in water at pH 2.5 and 20° C. of less than 10 g./l. Highly preferred materials are quaternary ammonium salts having two $C_{12}$–$C_{24}$ alkyl chains, optionally substituted or interrupted by functional groups such as —OH, —O—, —CONH, —COO—, etc.

Well-known species of substantially water-insoluble quaternary ammonium compounds have the formula

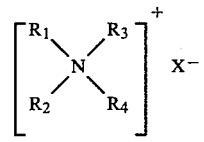

wherein $R_1$ and $R_2$ represent hydrocarbyl groups of from about 12 to about 24 carbon atoms; $R_3$ and $R_4$ represent hydrocarbyl groups containing from 1 to about 4 carbon atoms; and X is an anion, preferably selected from halide, methyl sulfate and ethyl sulfate radicals. Representative examples of these quaternary softeners include ditallow dimethyl ammonium chloride; ditallow dimethyl ammonium methyl sulfate; dihexadecyl dimethyl ammonium chloride; di(hydrogenated tallow alkyl) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; di(coconut alkyl) dimethyl ammonium chloride. Ditallow dimethyl ammonium chloride, di(hydrogenated tallow alkyl) dimethyl ammonium chloride, di(coconut alkyl) dimethyl ammonium chloride and di(coconut alkyl) dimethyl ammonium methosulfate are preferred.

Another class of preferred water-insoluble cationic materials are the alkylimidazolinium salts believed to have the formula

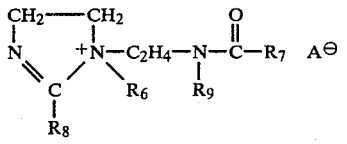

wherein $R_6$ is an alkyl containing from 1 to 4, preferably 1 or 2 carbon atoms, $R_7$ is an alkyl containing from 9 to 25 carbon atoms, $R_8$ is an alkyl containing from 8 to 25 carbon atoms, and $R_9$ is hydrogen or an alkyl containing from 1 to 4 carbon atoms and $A^-$ is an anion, preferably a halide, methosulfate or ethosulfate. Preferred imidazolinium salts include 1-methyl-1-(tallowylamido-)ethyl-2-tallowyl-4,5-dihydroimidazolinium methosulfate and 1-methyl-1-(palmitoylamido)ethyl-2-octadecyl-4,5-dihydroimidazolinium chloride. Other useful imidazolinium materials are 2-heptadecyl-1-methyl-1-(2-stearylamido)-ethyl-imidazolinium chloride and 2-lauryl-1-hydroxyethyl-1-oleyl-imidazolinium chloride. Also suitable herein are the imidazolinium fabric softening components of U.S. Pat. No. 4,127,489, incorporated herein by reference.

In the present invention, the water-insoluble cationic softener is present at a level of at least 8%; below this level, there is generally no difficulty in preparing emulsions of low viscosity (i.e. less than 500 cp) and good stability. The maximum level of cationic softener is determined by practical considerations; even when using the viscosity control agents of the present invention it is not generally possible to prepare stable, pourable emulsions containing more than 22% of cationic softener. When particularly high concentrations are desired, it is preferred to use an imidazolinium softener and preferred compositions contain from 12% to 20% of imidazolinium softener. When a di-long chain non-cyclic mono-quaternary softener is employed, it is preferred not to exceed a level of 16%, and a preferred range is 10% to 14%.

THE VISCOSITY CONTROL AGENT

The viscosity control agent in the compositions of the present invention can be selected from three classes of materials as described hereinafter. While not intending to be bound by theoretical considerations, it is believed that each of these types of viscosity control agent are present in the disperse phase of the aqueous emulsion and that it is important that the materials have a single long (about $C_9$–$C_{24}$) hydrocarbyl chain. The different classes of materials demonstrate their optimum viscosity-decreasing and anti-gelling effect at different carbon chain lengths.

The first class of viscosity control agent is represented by non-cyclic hydrocarbons, optionally substituted by halogen atoms, having from 10 to 20, preferably from 14 to 18, carbon atoms.

Preferably, hydrocarbons useful in the present invention are paraffins or olefins, but other materials, such as alkynes and halo-paraffins, for example myristyl chloride or stearyl bromide, are not excluded. Materials known generally as paraffin oil, soft paraffin wax and petrolatum are especially suitable. Examples of specific materials are tetradecane, hexadecane, octadecane and octadecene. Preferred commercially-available paraffin mixtures include spindle oil and light oil and technical grade mixtures of $C_{14}/C_{18}$ n-paraffins.

The second class of viscosity control agents is represented by materials of the general formula:

$$R_1COOR_2$$

wherein $R_1$ is a straight or branched chain alkyl or alkenyl group having from 8 to 23 carbon atoms and $R_2$ is hydrogen or an alkyl or hydroxyalkyl group having 1–4 carbon atoms.

Highly preferred materials of this class are the $C_{10}$ to $C_{20}$ saturated fatty acids, especially lauric acid, myristic acid, palmitic acid and stearic acid.

Esters of such acids with $C_1$–$C_3$ alcohols are also useful. Although these materials are not as effective at viscosity decrease as the acids, they have the advantage of being particularly effective at enhancing the softening effect of the compositions. Examples of such materials are methyl laurate, ethyl myristate, ethyl stearate, methyl palmitate and ethylene glycol monostearate.

It will be appreciated that aqueous rinse-added fabric softening compositions are normally formulated at slightly acid pH and the fatty acids are believed to be present in the composition in their acid form and not in the form of soaps.

The third class of viscosity control agent is represented by fatty alcohols, that is by compounds of the general formula:

$$R_3OH$$

wherein $R_3$ is a straight or branched chain alkyl or alkenyl group having from 10 to 18 carbon atoms. Specific examples of this class are decanol, dodecanol, tetradecanol, pentadecanol, hexadecanol and octadecanol. The most preferred materials are lauryl and palmityl alcohols.

These alcohols can be prepared by hydrogenation of the naturally occuring fatty acids or by any of the well-known synthetic routes, such as the oxo-process which results in primary alcohols having about 25% chain branching, predominantly short chain branching.

In the case of each of the above classes, the viscosity control agent is effective on a range of ratios of cationic fabric softener to viscosity control agent and in the present invention this ratio can range from 5:1 to 20:1, preferably 6:1 to 12:1, especially about 8:1. The viscosity control agent should be present in the composition in an amount from 0.5% to 4%.

Apart from lowering the viscosity of the compositions, the viscosity control agent exerts an anti-gelling effect and also, because each of the materials has a long fatty chain, the agent does contribute to some extent to the softening performance of the composition, a feature which is not shared by other known viscosity control agents, for example electrolytes and low molecular weight solvent materials. Compositions of the present invention also have enhanced dispersibility in cold water, better storage stability and exhibit less dispenser residues than conventional fabric softening composition based solely on a cationic fabric softener.

OPTIONAL INGREDIENTS

Fabric softening compositions of the present invention can also include various optional ingredients. In particular, the active fabric softening agent can comprise a mixture of the cationic fabric softener as hereinbefore described together with a nonionic fabric softener.

Useful nonionic fabric softeners are described in the German Offenlegungsschrift No. 2631 114, incorporated herein by reference, and are preferably fatty acid esters of polyhydric alcohols having up to 8 carbon atoms. Particularly preferred materials are the sorbitan esters and the glycerol esters, for example sorbitan monosterate, sorbitan mono-oleate and glycerol mono- and di-stearate. Fatty acid esters of monohydric alcohols having at least 4 carbon atoms, for example isobutyl stearate, are especially useful in this context. Such nonionic softeners can be used at levels of from 2% to 8% of the composition.

The composition of this invention may also comprise additional viscosity control agents, such as 1% to 10% of lower alcohols, especially ethanol and isopropanol, and electrolytes, for example calcium chloride, at levels of from 100 to 1000 ppm.

In addition to the above mentioned components, the compositions may contain silicones, as for example described in German Patent Application DOS 26 31 419 incorporated herein by reference. These materials can provide additional benefits such as ease of ironing. The optional silicone component can be used in an amount of from about 0.5% to about 6%, preferably from 1% to 4% of the softener composition.

The compositions herein can also contain other optional ingredients which are known to be suitable for use in textile softeners. Such adjuvants include emulsifiers, perfumes, preservatives, germicides, colorants, fungicides, stabilizers, brighteners and opacifiers. These adjuvants, if used, are normally added at their conventional low levels (e.g., from about 0.1% to 5% by weight).

The compositions can normally be prepared by mixing the ingredients together in water, heating to a temperature of about 60° C. and agitating for 5–30 minutes.

At 60° C., most of the water-insoluble materials useful herein exist in liquid form and therefore form liquid/liquid phase emulsions with an aqueous continuous phase. On cooling, the disperse phase may wholly or partially solidify so that the final composition exists as a dispersion which is not a true liquid/liquid emulsion. It will be understood that the term "dispersion" means liquid/liquid phase or solid/liquid phase dispersions and emulsions.

The pH of the compositions is generally adjusted to be in the range from about 3 to about 8, preferably from about 4 to about 6.

When compositions of the present invention are added to the rinse liquor, a concentration from about 10 ppm to 1000 ppm, preferably from about 50 ppm to about 500 ppm, of total active ingredient is appropriate.

The following examples illustrate the invention.

EXAMPLE I

A concentrated liquid fabric softener having the following composition was prepared by dispersing the active ingredients into water at about 60° C.

| Ingredients | Parts by weight |
|---|---|
| *1-methyl-1-(tallowylamido-)ethyl-2-tallowyl-4,5-dihydroimidazolinium methosulfate | 12 (on 100% active basis) |
| Myristic acid | 1.5 |
| Water | to 100 |

The composition had a viscosity of about 125 cp. after 5 days storage and showed no signs of phase separation. A similar composition but without myristic acid had a viscosity of 900 cp. after 5 days.

EXAMPLE II

A concentrated liquid fabric softener having the following composition was prepared in an analogous manner to the composition of Example I.

| Ingredients | Parts by weight |
|---|---|
| *1-methyl-1-(tallowylamido-)ethyl-2-tallowyl-4,5-dihydroimidazolinium methosulfate | 16 |
| Technical grade mixture of $C_{15}$–$C_{18}$ n-paraffins (m. pt. 4° C.) | 2 |
| Calcium chloride | 0.01 |
| Water | to 100 |

This composition had a viscosity of 365 cp. after storage for 8 days and showed no signs of phase separation. A similar composition without the paraffin material had a viscosity of 1750 cp. after the same period and is in gel form.

EXAMPLES III–XIV

Compositions were prepared in an analogous manner, each of which contained 16% of 1-methyl-1-(tallowylamido-)ethyl-2-tallowyl-4,5-dihydroimidazolinium methosulfate and containing the following ingredients in aqueous dispersion.

| Example No. | |
|---|---|
| III | 1% $C_{15}$–$C_{18}$ paraffin mixture<br>.01% Calcium chloride |
| IV | 3% $C_{15}$–$C_{18}$ paraffin mixture<br>.01% Calcium chloride |
| V | 2% $C_{15}$–$C_{18}$ paraffin mixture<br>1% Isobutyl stearate<br>.01% Calcium chloride |
| VI | 2% $C_{15}$–$C_{18}$ paraffin mixture<br>.01% Calcium chloride |
| VII | 2% methyl palmitate<br>.025% Calcium chloride |
| VIII | 2% Methyl laurate<br>.025% Calcium chloride |
| IX | 2% Ethylene glycol monolaurate<br>.025% Calcium chloride |
| X | 2% Stearic acid<br>.025% Calcium chloride |
| XI | 2% Palmitic acid<br>.025% Calcium chloride |
| XII | 2% Behenic acid<br>.025% Calcium chloride |
| XIII | 3% Octadecanol<br>.025% Calcium chloride |
| XIV | 2% Undecanol<br>.025% Calcium chloride |

The compositions of the above examples had good phase stability and a viscosity suitable for consumer use.

EXAMPLES XV–XX

The following compositions were also prepared.

| Ingredients | Example No. XV | XVI | XVII | XVIII | XIX | XX |
|---|---|---|---|---|---|---|
| | % | % | % | % | % | % |
| *1-methyl-1-(tallowyl-amido-)ethyl-2-tallow-yl-4,5-dihydroimida-zolinium methosulfate | 20 | — | — | — | — | — |
| *Ditallow dimethyl ammonium chloride | — | 14 | 8 | 10 | 12 | 12 |
| $C_{15}$–$C_{18}$ paraffin mixture | — | — | — | — | 1.5 | — |
| Myristic acid | — | — | 1 | 1.25 | — | — |
| Lauric acid | 2.5 | — | — | — | — | 1.5 |
| Hexadecanol | — | 2 | — | — | — | — |
| Calcium chloride | 0.25 | .05 | .01 | .01 | .025 | .025 |

All the above compositions were stable, pourable dispersions with excellent fabric softening properties.

*In the material marked with an asterisk in Examples 1–15, the tallow substituents are in fact hydrogenated tallow substituents.

I claim:

1. A fabric softening composition in the form of an aqueous dispersion comprising (a) from 8% to 22% of a water-insoluble cationic fabric softener and (b) from 0.5% to 4% of a viscosity control agent selected from the group consisting of $C_9$–$C_{24}$ fatty acids and mixtures thereof, wherein the ratio of (a) to (b) is from 6:1 to 20:1.

2. A composition according to claim 1 consisting of (a) 12% 1-methyl-1-(tallowylamido-)ethyl-2-tallowyl-4,5-dihydroimidazolinium methosulfate, (b) 1.5% myristic acid, (c) with the balance being water.

3. A composition according to claim 1, wherein the cationic fabric softener is (i) from 8% to 16% of a di-$C_{12}$-$C_{24}$ alkyl or alkenyl mono-quaternary ammonium salt or (ii) from 8% to 22% of a di-$C_{12}$-$C_{24}$ alkyl or alkenyl imidazolinium salt.

4. A composition according to claim 3, wherein the imidazolinium salt has the general formula:

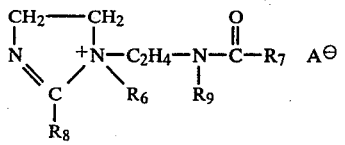

wherein $R_6$ is an alkyl containing from 1 to 4 carbon atoms, $R_7$ is an alkyl containing from 9 to 25 carbon atoms, $R_8$ is an alkyl containing from 8 to 25 carbon atoms, and $R_9$ is hydrogen or an alkyl containing from 1 to 4 carbon atoms and $A^-$ is an anion selected from the group consisting of halide, methosulfate and ethosulfate.

5. A composition according to claim 4, wherein the ratio of (a) to (b) is from 6:1 to 12:1.

6. A composition according to claim 5 additionally comprising from 100 to 1000 ppm. of electrolyte.

7. A composition according to claim 6 additionally comprising from 2% to 8% of a water-insoluble nonionic softener.

8. A fabric softening composition in the form of an aqueous dispersion comprising (a) from 8% to 22% of a water-insoluble cationic fabric softener and (b) from 0.5% to 4% of a viscosity control agent selected from the group consisting of $C_9$–$C_{24}$ fatty acids and mixtures thereof, wherein the ratio of (a) to (b) is from 5:1 to 20:1.

* * * * *

Notice of Adverse Decisions in Interference

In Interference No. 101,537, involving Patent No. 4,426,299, M. W. Verbruggen, CONCENTRATED FABRIC SOFTENING COMPOSITION, final judgement adverse to the patentee was rendered Aug. 23, 1989, as to claims 1-8.

[*Official Gazette October 23, 1990*]